US009903636B2

(12) United States Patent
Koo

(10) Patent No.: US 9,903,636 B2
(45) Date of Patent: Feb. 27, 2018

(54) ICE MAKING SYSTEM AND METHOD FOR REFRIGERATOR

(71) Applicant: Dongbu Daewoo Electronics Corporation, Seoul (KR)

(72) Inventor: Min Bon Koo, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 191 days.

(21) Appl. No.: 14/836,898

(22) Filed: Aug. 26, 2015

(65) Prior Publication Data

US 2016/0370089 A1 Dec. 22, 2016

(30) Foreign Application Priority Data

Jun. 16, 2015 (KR) ..... 10-2015-0085271

(51) Int. Cl.

| | |
|---|---|
| ***F25C 1/00*** | (2006.01) |
| ***F25D 17/06*** | (2006.01) |
| ***F25C 5/00*** | (2018.01) |
| ***F25D 23/02*** | (2006.01) |
| ***F25D 23/06*** | (2006.01) |
| *F25C 5/18* | (2018.01) |

(52) U.S. Cl.

CPC ..... *F25D 17/065* (2013.01); *F25C 1/00* (2013.01); *F25C 5/005* (2013.01); *F25D 17/062* (2013.01); *F25D 23/028* (2013.01); *F25D 23/065* (2013.01); *F25D 23/068* (2013.01); *F25C 5/182* (2013.01); *F25C 2400/10* (2013.01); *F25D 2317/062* (2013.01)

(58) Field of Classification Search

CPC ..... F25C 1/00; F25C 5/005
USPC ..... 62/66, 344, 440, 441
See application file for complete search history.

(56) References Cited

U.S. PATENT DOCUMENTS

| | | | |
|---|---|---|---|
| 3,568,465 | A | 3/1971 | Jung |
| 8,434,322 | B2 | 5/2013 | Lee et al. |
| 2005/0210909 | A1 | 9/2005 | Kim et al. |
| 2010/0011796 | A1 | 1/2010 | Lee |
| 2010/0101260 | A1 | 4/2010 | Lee et al. |

(Continued)

FOREIGN PATENT DOCUMENTS

| | | |
|---|---|---|
| KR | 20-1999-0030012 U | 7/1999 |
| KR | 10-2005-0098135 | 10/2005 |

(Continued)

OTHER PUBLICATIONS

Derwent Acc-No. 2015-70077J, YEO TC, Solenoid valves.*
Extended European Search Report dated Nov. 15, 2016 issued in corresponding European Patent Application No. 15186853.6.

*Primary Examiner* — Melvin Jones

(57) ABSTRACT

A method and system for ice making in a refrigerator is disclosed. The ice making system comprising an ice making unit that makes ice cubes in a refrigerator compartment door, a cool air producing unit that is provided in a refrigerator body and cools air inside a cooling duct, a connection unit that connects the ice making unit to the cooling duct in response to a closure of the refrigerator compartment door onto the refrigerator body, and a cool air circulation unit that supplies the cool air from the cool air producing unit to the ice making unit and discharges the cool air from the ice making unit to the cool air producing unit.

7 Claims, 6 Drawing Sheets

(56) References Cited

U.S. PATENT DOCUMENTS

| | | | |
|---|---|---|---|
| 2010/0251748 | A1 | 10/2010 | Park |
| 2010/0326096 | A1 | 12/2010 | Junge et al. |

FOREIGN PATENT DOCUMENTS

| | | | |
|---|---|---|---|
| KR | 10-2006-0039169 | A | 5/2006 |
| KR | 10-2010-0111481 | A | 10/2010 |

* cited by examiner

ICE MAKING SYSTEM AND METHOD FOR REFRIGERATOR

BACKGROUND OF THE INVENTION

Field of the Invention

The present invention relates to a method and system for making ice for a refrigerator.

Description of the Related Art

A refrigerator is an appliance that serves to store food at low temperatures; it may be configured to store food at temperatures below freezing or at low but above freezing temperatures.

The temperature inside the refrigerator is maintained at the desired level by cool air that is continuously supplied to the refrigerator. The cool air is continuously produced by a heat exchange operation between air and a refrigerant performed in a refrigeration cycle comprising four sequential phases: compression, condensation, expansion, and evaporation. Cool air is channeled to the inside of the refrigerator and is evenly distributed inside the refrigerator by convection.

The body of a refrigerator typically has a rectangular hexahedral shape that opens frontward, with a refrigerator compartment and a freezer compartment defined and isolated from one another within the refrigerator body. The open front of the refrigerator body may comprise both a refrigerator compartment door and a freezer compartment door that can open or close the refrigerator compartment and the freezer compartment, respectively. The storage space defined inside the refrigerator may comprise a plurality of drawers, shelves, and boxes designed to store various kinds of food in various optimal states.

In the related art, a top mount type refrigerator in which the freezer compartment is provided in the upper part of the refrigerator body and the refrigerator compartment is provided in the lower part of the refrigerator body is well known. However, in recent years, for greater convenience to users, a bottom freezer type refrigerator in which the freezer compartment is provided in the lower part of the refrigerator body has been proposed and used. Here, the bottom freezer type refrigerator may be preferable since the more frequently used refrigerator compartment is located in the upper part of the refrigerator body and the less frequently used freezer compartment is located in the lower part of the refrigerator body. However, the bottom freezer type refrigerator is problematic in that to take ice cubes from the freezer compartment, a user must open the freezer compartment door and collect ice cubes while bending.

In an effort to solve the problem, in recent years, a refrigerator in which an ice dispenser for dispensing ice cubes is provided in a refrigerator compartment door placed in the upper part of a bottom freezer type refrigerator has been proposed and used. In such a refrigerator, an ice making device for making ice cubes may be provided in the refrigerator compartment door or inside the refrigerator compartment.

For example, in a bottom freezer type refrigerator having an ice making device in the refrigerator compartment door, cool air that has been produced by an evaporator is divided and discharged both into the freezer compartment and into the refrigerator compartment. Here, cool air that was discharged into the freezer compartment flows to the ice making device via a cool air supply duct arranged in a sidewall of the refrigerator body, and then freezes water while circulating inside the ice making device. Thereafter, the cool air is discharged from the ice making device into the refrigerator compartment via a cool air restoration duct arranged in the sidewall of the refrigerator body, so that the cool air can reduce the temperature inside the refrigerator compartment.

Here, to make ice cubes using the ice making device in the above-mentioned refrigerator, cool air should flow to the ice making device via the cool air supply duct and should flow from the ice making device via the cool air restoration duct; this way, the refrigerator is more efficient because cool air flows to the refrigerator compartment via both the cool air supply duct and the cool air restoration duct.

Further, in the refrigerator, the ice making device is located on the refrigerator compartment door, while the cool air supply and cool air restoration ducts are provided in the refrigerator body, so the refrigerator is problematic in that when the cool air flows from the cool air supply duct to the ice making device or flows from the ice making device to the cool air restoration duct, the cool air may leak from the junction between the refrigerator compartment door and the refrigerator body.

Document of Related Art (Patent Document) Korean Patent Application Publication No. 10-2005-0098135 (published on Oct. 11, 2005)

SUMMARY OF THE INVENTION

The present invention has been conceived with the above problems in mind; it proposes an ice making system and method for a refrigerator which can efficiently supply cool air produced from a cooling duct of the refrigerator body to the ice making unit of the refrigerator compartment door without allowing leakage of the cool air.

In one aspect of the present invention, an ice making system for a refrigerator is provided, including: an ice making unit that makes ice cubes in a refrigerator compartment door; a cool air producing unit that is provided in a refrigerator body and cools air inside a cooling duct so as to produce cool air; a connection unit that communicates the ice making unit to the cooling duct in response to a closing action of a refrigerator compartment door onto the refrigerator body; and a cool air circulation unit that supplies the cool air from the cool air producing unit to the ice making unit and discharges the cool air from the ice making unit to the cool air producing unit.

Exemplary embodiments of the present invention are advantageous in that when a refrigerator compartment door is closed onto a refrigerator body, the junction between the refrigerator body and the refrigerator compartment door is closely sealed, so the embodiments can prevent leakage of cool air from the junction between the refrigerator body and the refrigerator compartment door.

Another advantage of the exemplary embodiments of the present invention resides in that the embodiments can efficiently supply cool air produced in a cooling duct in the refrigerator body to an ice making unit of the refrigerator compartment door without leakage of the cool air.

A further advantage of the exemplary embodiments of the present invention resides in that the embodiments allow for the making of ice cubes directly using the cool air produced from the cooling duct, thereby increasing the efficiency of ice making and cool air supplying.

Still another advantage of the exemplary embodiments of the present invention resides in that the cool air circulates only a short distance within the ice making space located between the cooling duct and the refrigerator compartment door, in contrast to a conventional technique in which cool air produced in the lower part of a refrigerator flows to an ice making space located in a refrigerator compartment door. The present invention can efficiently reduce the loss of cool air and save electricity.

BRIEF DESCRIPTION OF THE DRAWINGS

The above and other objects and features of the present invention will become apparent from the following description of exemplary embodiments given in conjunction with the accompanying drawings.

DETAILED DESCRIPTION OF THE INVENTION

Hereinafter, exemplary embodiments of the present invention will be described in detail with reference to the accompanying drawings so that they can be readily implemented by someone skilled in the art.

Figure 1:
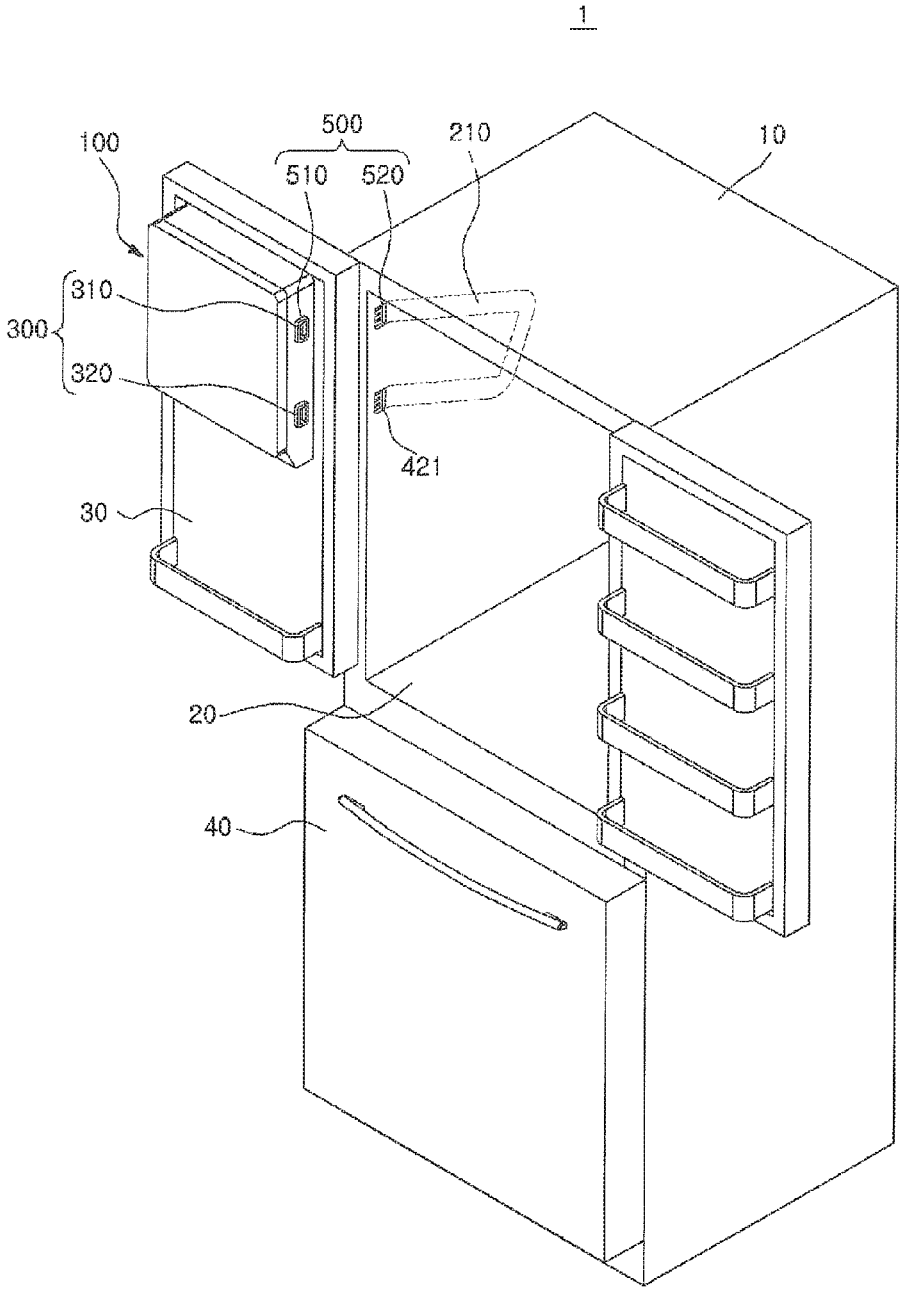
FIG. 1 is a perspective view showing an ice making system for a refrigerator according to an exemplary embodiment of the present invention.
Figure 2:
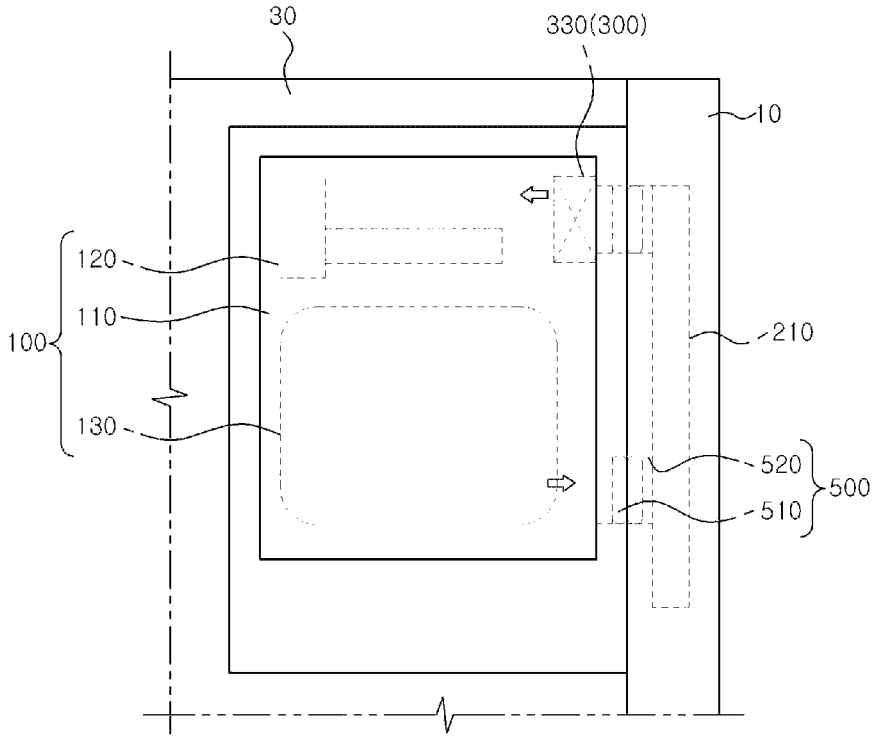
FIG. 2 shows the internal structure of an ice making system in a refrigerator according to the exemplary embodiment of the present invention.
Figure 3:
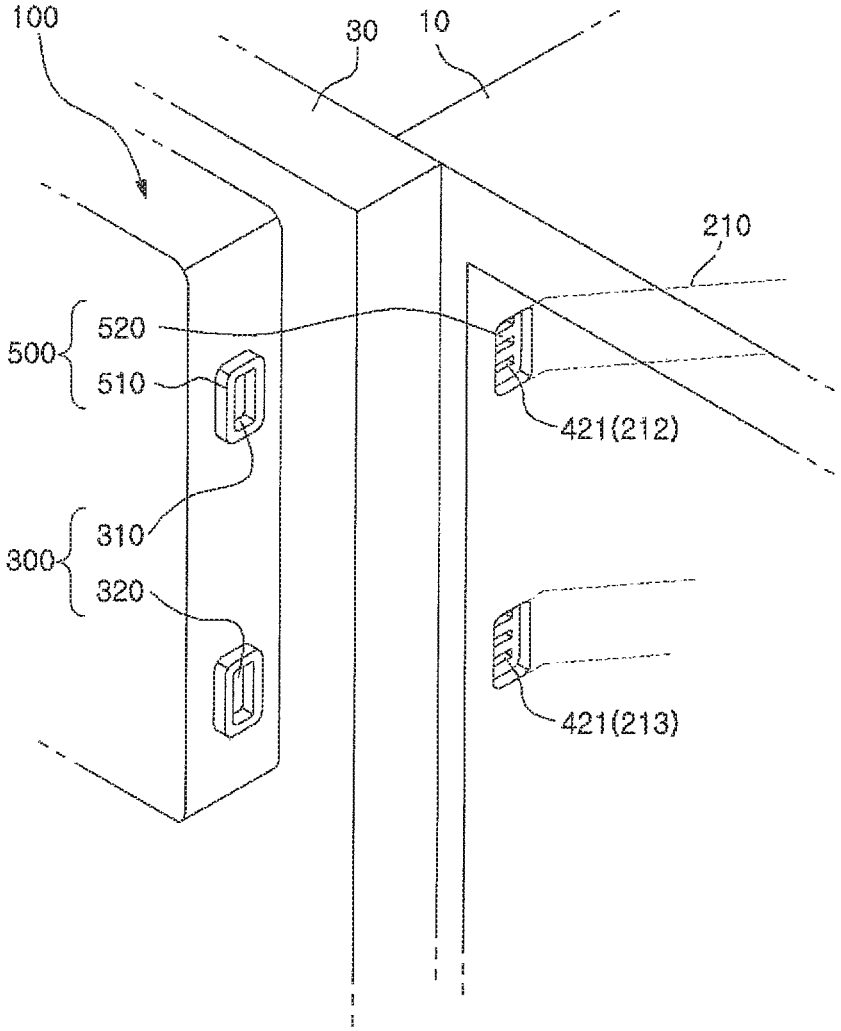
FIG. 3 shows the structure of a connection unit of the ice making system for a refrigerator according to the exemplary embodiment of the present invention.

FIG. 1 is a perspective view showing an ice making system for a refrigerator according to an exemplary embodiment of the present invention. FIG. 2 is a view showing the internal structure of an ice making system for a according to the exemplary embodiment of the present invention. FIG. 3 is an enlarged view showing the structure of a connection unit of the ice making system for a refrigerator according to the exemplary embodiment of the present invention.

As shown in FIGS. 1 to 3, the ice making system for the refrigerator according to the exemplary embodiment of the present invention can efficiently supply cool air produced in a cooling duct 210 of a refrigerator body into the ice making cabinet 110 of an ice making unit 100 provided in a refrigerator compartment door without leakage of the cool air.

Here, the refrigerator 1 may include: a refrigerator body 10; a barrier 20 that divides the interior of the refrigerator body 10 into a refrigerator compartment and a freezer compartment; one or more refrigerator compartment doors 30 hinged to an edge of the front of the refrigerator compartment and open and close the refrigerator compartment; and a freezer compartment door 40 that is hinged to an edge of the front of the freezer compartment, and opens and closes the freezer compartment. Although the refrigerator 1 of the exemplary embodiments of the present invention is a bottom freezer type refrigerator in which the freezer compartment is provided in the lower part of the refrigerator body, it should be understood that the present invention may be adapted to various types of refrigerators without being limited to the bottom freezer type.

The ice making system of the present invention may include an ice making unit 100, a cool air producing unit 200, a cool air circulation unit 300, and a connection unit 500.

Described in detail, the ice making unit 100 is a unit that changes the state of water to ice using cool air, and may be provided on an inner surface of the refrigerator compartment door 30. Although the ice making unit 100 of the present embodiment is provided on the upper part of the refrigerator compartment door 30, it should be understood that the ice making unit 100 may be provided elsewhere on the refrigerator compartment door 30.

The ice making unit 100 may include an ice making cabinet 110, an ice maker 120, and an ice bank 130.

Here, the ice making cabinet 110 may be provided on the inside surface of the refrigerator compartment door 30, and may define an ice making space in which ice cubes are produced. The ice maker 120 can freeze water using cool air flowing into the ice making space, make ice cubes, and discharge the ice cubes into the ice bank 130. The ice bank 130 is provided at a location below the ice maker 120 so as to receive ice cubes discharged from the ice maker 120. The ice bank 130 can store the ice cubes discharged from the ice maker 120, and can dispense ice cubes to users via an ice dispenser unit (not shown).

The cool air circulation unit 300 serves to introduce cool air from the cool air producing unit 200 into the ice making space of the ice making unit 100 or to discharge the cool air from the ice making space to the cool air producing unit 200.

For example, the cool air circulation unit 300 may include: an inlet hole 310 provided on an upper part of the ice making unit 100 at a location corresponding to a first duct hole 212 of the cooling duct 210; an outlet hole 320 provided on a lower part of the ice making unit 100 at a location corresponding to a second duct hole 213 of the cooling duct 210; and a circulation fan 330 that channels the cool air from the inlet hole 310 to the outlet hole 320.

Particularly, the cooling duct 210 is located in the refrigerator body 10, and the ice making unit 100 is located on the refrigerator compartment door 30 of the refrigerator 1, so that when the refrigerator compartment door 30 is closed onto the refrigerator body 10, the first duct hole 212 and the second duct hole 213 of the cooling duct 210 communicate with the inlet hole 310 and the outlet hole 320 of the ice making unit 100, respectively.

Thus, when the refrigerator compartment door 30 is closed onto the refrigerator body 10, the cool air inside the cooling duct 210 flows into the inlet hole 310 of the ice making unit 100 via the first duct hole 212. In the ice making unit 100, the cool air circulates inside the ice making space 111 by the operation of the circulation fan 330, thereby freezing water inside the ice making space 111 and making ice cubes. Thereafter, the cool air inside the ice making unit 100 is discharged into the second duct hole 213 of the cooling duct 210 via the outlet hole 320. The cool air discharged from the ice making unit 100 is cooled again inside the cooling duct 210 prior to being introduced into the inlet hole 310 of the ice making unit 100.

The connection unit 500 can connect the ice making space of the ice making unit 100 with a cooling line of the cooling duct 210 in response to the closing of the refrigerator compartment door 30 onto the refrigerator body 10.

To this end, the connection unit 500 may include: a hollow sealing gasket 510; and a cool air depression 520 having a plurality of holes 421. Here, the sealing gasket 510 is a hollow sealing protuberance from the refrigerator compartment door 30 in such a way that the sealing gasket 510 can communicate with the ice making space of the ice making unit 100. The sealing gasket 510 may be provided with a bellows part.

Further, the cool air depression 520 of the connection unit 500 may be located on the refrigerator body 10 at a position corresponding to the sealing gasket 510 when the refrigerator compartment door 30 is closed onto the refrigerator body 10. Here, the cool air depression 520 may be located on the refrigerator body 10 in such a way that the sealing gasket 510 can be inserted into the cool air depression 520. The cool air depression 520 may comprise a plurality of holes 421 that communicate with the first duct hole 212 and the second duct hole 213 of the cooling duct 210.

When the refrigerator compartment door 30 is closed onto the refrigerator body 10, the sealing gasket 510 and the cool air depression 520 can constitute an airtight sealing of the junction between the refrigerator body 10 and the refrigerator compartment door 30, so the embodiment of the present invention can prevent the leakage of cool air from the junction between the refrigerator body 10 and the refrigerator compartment door 30.

Figure 4:
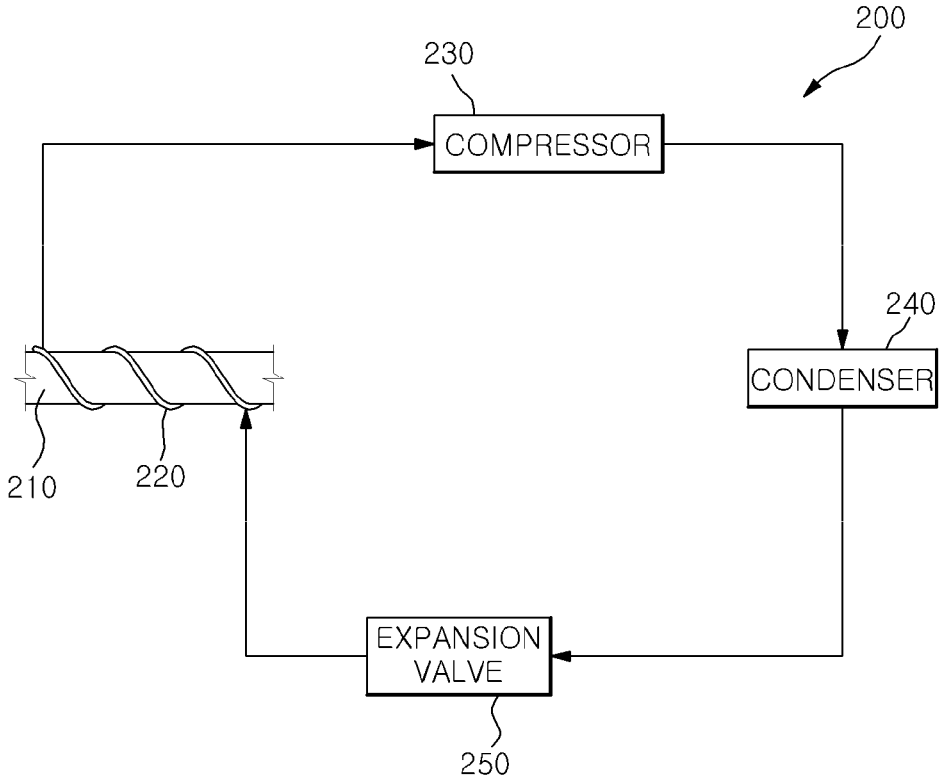
FIG. 4 is a block diagram showing the structure of a cool air producing unit for an ice making system in a refrigerator according to the exemplary embodiment of the present invention.

FIG. 4 is a block diagram showing the structure of the cool air producing unit of the ice making system for the refrigerator according to the exemplary embodiment of the present invention.

As shown in FIG. 4, the cool air producing unit 200 can cool the air flowing through the cooling duct 210, thereby producing cool air, and can supply this cool air to the ice making unit 100. The cool air producing unit 200 may be located inside the refrigerator body 10 of the refrigerator 1. More specifically, the cool air producing unit 200 may be located on the sidewall of the refrigerator body 10 and in the lower part of the refrigerator body 10.

The cool air producing unit 200 includes: the cooling duct 210 that is provided in the sidewall of the refrigerator body so as to form a cooling line through which air flows; an evaporation coil 220 wound around the cooling duct 210 such that the air inside the cooling duct is cooled by a heat exchange operation between the air and a refrigerant; a compressor 230 that compresses the refrigerant discharged from the evaporation coil 220 so as to change the refrigerant to a high temperature and high pressure gas refrigerant; a condenser 240 that condenses the gas refrigerant so as to change the gas refrigerant to a high pressure liquid refrigerant; and an expansion valve 250 that performs adiabatic expansion of the liquid refrigerant and supplies the refrigerant to the evaporation coil 220. Here, the first duct hole 212 may be provided on the upper end of the cooling duct 210 such that the first duct hole 212 can communicate with the inlet hole 310, and the second duct hole 213 may be located on the lower end of the cooling duct 210 such that the second duct hole 213 can communicate with the outlet hole 320.

The refrigeration cycle involves the compressor 230, the condenser 240, the expansion valve 250 and the evaporation coil 220, and comprises four processes: compression, condensation, expansion, and evaporation. This results a heat exchange between the air and the refrigerant. Accordingly, air inside the cooling duct 210 may be cooled to become cool air by a heat exchange operation performed between the air inside the cooling duct 210 and the refrigerant inside the evaporation coil 220. Here, the evaporation coil 220 cools the cooling duct 210 through heat conduction. Further, the cooling line is sufficiently long that air inside the cooling line can be efficiently cooled, so when the air flows through the cooling line for a predetermined lengthy period of time, the air can be cooled to a predetermined temperature (for example, 14 degrees below zero or lower) at which the cool air can efficiently make ice cubes.

Accordingly, the refrigerant may circulate through a refrigeration cycle composed of the evaporation coil 220, the compressor 230, the condenser 240, and the expansion valve 250, thereby cooling the cool air supplied to the ice making unit 100.

Here, although the compressor 230, the condenser 240, and the expansion valve 250 in the exemplary embodiment of the present invention form a refrigeration cycle that can supply cool air to the ice making unit 100, the refrigeration cycle may supply the cool air to both the refrigerator compartment and the freezer compartment of the refrigerator. Further, the compressor 230, the condenser 240, and the expansion valve 250 may use the refrigerant used in an evaporator (not shown) provided to supply cool air to both the refrigerator compartment and the freezer compartment.

Figure 5:
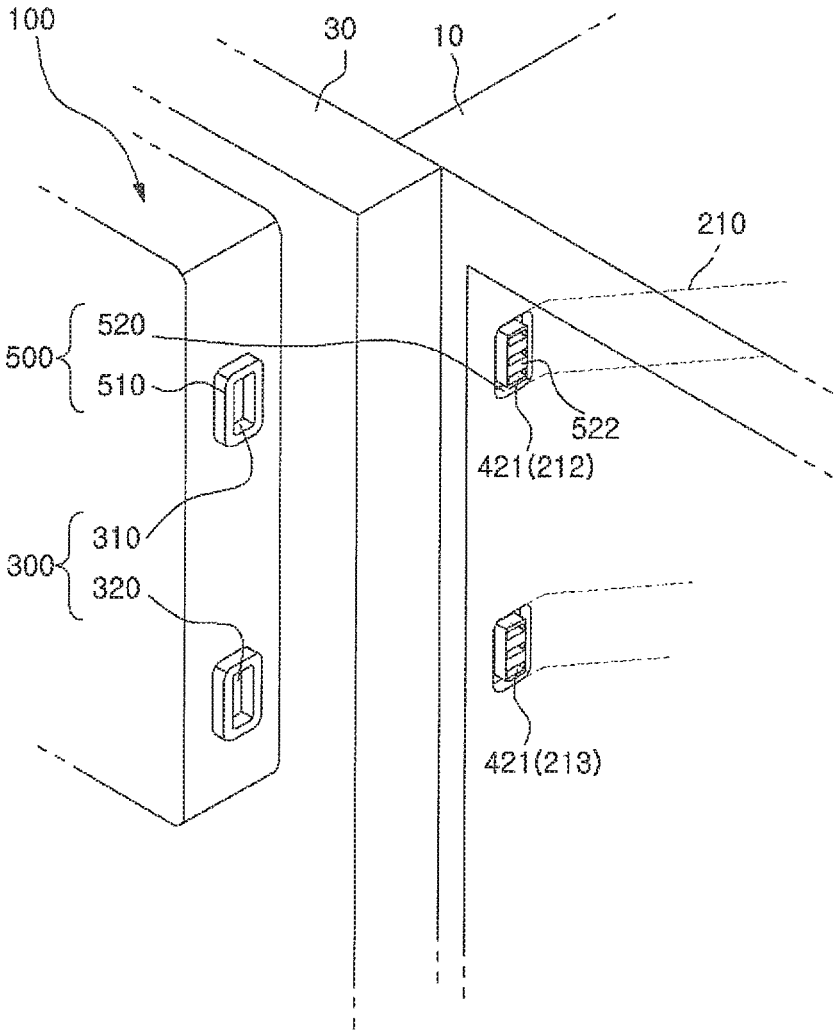
FIG. 5 is an enlarged view showing the structure of a connection unit for an ice making system in a refrigerator according to a second exemplary embodiment of the present invention.

FIG. 5 is an enlarged view showing the structure of the connection unit of an ice making system for a refrigerator according to a second exemplary embodiment of the present invention.

As shown in FIG. 5, the cool air depression 520 of the connection unit 500 according to the second exemplary embodiment of the present invention may comprise ribs 522 that are seated in an internal space of the sealing gasket 510 when the sealing gasket 510 is inserted into the cool air depression 520.

Here, the ribs 522 may protrude from the lower surface of the cool air depression 520, and may comprise a plurality of holes 421 that communicate with the first duct hole 212 and the second duct hole 213 of the cooling duct 210.

When the sealing gasket 510 is inserted into the cool air depression 520 by closing the refrigerator compartment door 30 onto the refrigerator body 10, the ribs 522 are seated in the internal space of the sealing gasket 510, thereby constituting a closer sealing of the junction between the refrigerator body 10 and the refrigerator compartment door 30.

Figure 6:
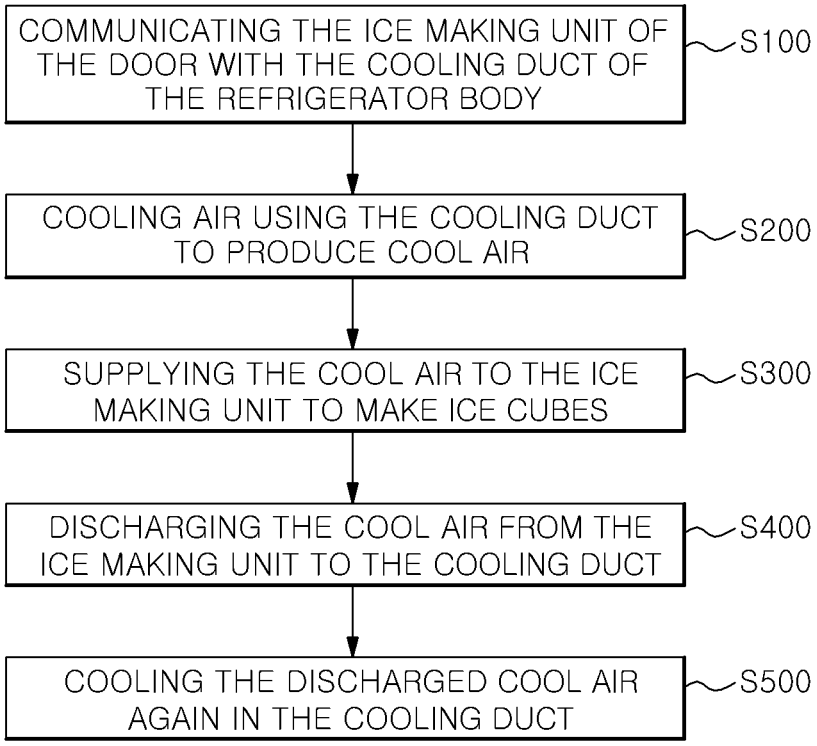
FIG. 6 is a block diagram showing an ice making method for a refrigerator according to an exemplary embodiment of the present invention.

FIG. 6 is a block diagram shows a method for making ice in a refrigerator according to an exemplary embodiment of the present invention.

As shown in FIG. 6, the ice making method for the refrigerator according to the exemplary embodiment of the present invention may include: a step of connecting the ice making unit located on the refrigerator compartment door with the cooling duct located in the refrigerator body (S100); a step of cooling air using the cooling duct so as to produce cool air (S200); a step of supplying the cool air to the ice making unit (S300); a step of discharging the cool air from the ice making unit into the cooling duct (S400); and a step of cooling the discharged cool air again in the cooling duct (S500).

In the step of connecting the ice making unit located on the refrigerator compartment door with the cooling duct located in the refrigerator body (S100), the sealing gasket located on the refrigerator compartment door is inserted into the cool air depression provided on the refrigerator body by closing the refrigerator compartment door onto the refrigerator body. Here, the sealing gasket and the cool air depression can realize close sealing of the junction between the refrigerator body and the refrigerator compartment door, thereby preventing leakage of cool air from the junction between the refrigerator body and the refrigerator compartment door.

In the step of cooling air using the cooling duct so as to produce cool air (S200), air is cooled to become cool air by making the air flow through the cooling duct on which the evaporation coil is wound. In this case, the air inside the cooling duct flows through the cooling line for a predetermined period of time while losing heat to the refrigerant flowing in the evaporation coil, so the air discharged from the cooling line can be cooled to a predetermined temperature (for example, 14 degrees below zero or lower) at which the cool air can efficiently make ice cubes.

In the step of supplying the cool air to the ice making unit (S300), the cool air cooled in the cooling duct is supplied to the ice making space of the ice making unit through the inlet hole of the ice making unit. Here, the cool air supplied to the ice making space circulates in the ice making space by the operation of the circulation fan, and can freeze water inside the ice making space, thereby making ice cubes.

In the step of discharging the cool air from the ice making unit to the cooling duct (S400), the cool air is discharged from the ice making space into the cooling duct through the outlet hole of the ice making unit.

In the step of cooling the discharged cool air again in the cooling duct (S500), the cool air discharged into the cooling duct flows through the cooling line of the cooling duct for a predetermined period of time, thereby being cooled to a predetermined temperature or lower at which the cool air can freeze water to make ice cubes.

While the invention has been shown and described with respect to the exemplary embodiments, it will be understood by those skilled in the art that various changes and modifications may be made without departing from the spirit and scope of the invention as defined in the following claims.

What is claimed is:

1. An ice making system for a refrigerator, the ice making system comprising:

an ice making unit that makes ice cubes in a refrigerator compartment door;

a cool air producing unit that includes a cooling duct through which air flows and is located in a refrigerator body to produce cool air;

a connection unit that connects the ice making unit with the cooling duct in response to the closure of the refrigerator compartment door onto the refrigerator body; and a cool air circulation unit that supplies the cool air from the cool air producing unit to the ice making unit and discharges the cool air from the ice making unit to the cool air producing unit, wherein the connection unit includes:

a hollow sealing gasket protruding from the refrigerator compartment door such that the sealing gasket communicates with an ice making space of the ice making unit; and a cool air depression provided on the refrigerator body by being depressed so that the sealing gasket is inserted into the cool air depression.

2. The ice making system for the refrigerator according to claim 1, wherein the cool air depression includes a plurality of cool air holes that are seated in an internal space of the sealing gasket and communicate with the cooling duct when the sealing gasket is inserted into the cool air depression.

3. The ice making system for the refrigerator according to claim 1, wherein the cool air producing unit includes:

the cooling duct through which the air flows;

an evaporation coil wound around the cooling duct such that the air is cooled by a heat exchange operation between the air and a refrigerant;

a compressor that compresses the refrigerant discharged from the evaporation coil so as to change the refrigerant to a high temperature and high pressure gas refrigerant;

a condenser that condenses the gas refrigerant so as to change the gas refrigerant to a high pressure liquid refrigerant; and an expansion valve that performs adiabatic expansion of the liquid refrigerant and supplies the refrigerant to the evaporation coil.

4. The ice making system for the refrigerator according to claim 1, wherein the ice making unit includes:

an ice making cabinet defining an ice making space;

an ice maker making the ice cubes using the cool air; and an ice bank storing the ice cubes.

5. The ice making system for the refrigerator according to claim 1, wherein the cool air circulation unit includes:

an inlet hole provided on an upper part of the ice making unit such that the cool air flows from the cooling duct into the ice making unit;

an outlet hole provided on a lower part of the ice making unit such that the cool air is discharged from the ice making unit into the cooling duct; and a circulation fan that channels the cool air from the inlet hole to the outlet hole.

6. An ice making method for a refrigerator, the method comprising:

connecting an ice making unit located on a refrigerator compartment door with a cooling duct located in a refrigerator body;

cooling air using the cooling duct so as to produce cool air;

supplying the cool air to the ice making unit;

discharging the cool air from the ice making unit to the cooling duct; and cooling the discharged cool air again in the cooling duct, wherein in the connecting of the ice making unit located on the refrigerator compartment door with the cooling duct located in the refrigerator body, a hollow sealing gasket protruding from the refrigerator compartment door is closely inserted into a cool air depression provided on the refrigerator body by being depressed, thereby communicating the ice making unit with the cooling duct.

7. The ice making method for the refrigerator according to claim 6, wherein the air flows through a cooling line of the cooling duct for a predetermined period of time, thereby being cooled to a predetermined temperature or lower and producing the cool air.

* * * * *